United States Patent [19]

Tolley et al.

[11] 4,312,841

[45] Jan. 26, 1982

[54] ENHANCED HYDROMETALLURGICAL RECOVERY OF COBALT AND NICKEL FROM LATERITES

[75] Inventors: William K. Tolley, Salt Lake City, Utah; Pieter D. Rademaker, Tucson, Ariz.

[73] Assignee: UOP Inc., Des Plaines, Ill.

[21] Appl. No.: 162,970

[22] Filed: Jun. 25, 1980

[51] Int. Cl.[3] ..... C01G 51/00; C01G 53/00

[52] U.S. Cl. ..... 423/150

[58] Field of Search ..... 423/150, 240 S, 32; 75/82, 113

[56] References Cited

U.S. PATENT DOCUMENTS

| | | | |
|---|---|---|---|
| 3,725,039 | 4/1973 | Jepsen | 75/113 |
| 3,772,423 | 11/1973 | Stevens | 423/150 |
| 3,845,189 | 10/1974 | Miller | 423/150 |
| 4,062,675 | 12/1977 | Dor | 75/82 |
| 4,187,281 | 2/1980 | Stauter | 423/150 |
| 4,201,751 | 5/1980 | Holter | 423/240 S |

*Primary Examiner*—Brian E. Hearn

*Attorney, Agent, or Firm*—James R. Hoatson, Jr.; Raymond H. Nelson; William H. Page, II

[57] ABSTRACT

The present process involves an improvement in the hydrometallurgical recovery of metal values from metal bearing sources such as ores and the like. The metal values are obtained by subjecting a metal bearing source to a reductive roast at an elevated temperature followed by cooling the reduced metal bearing source, extracting the cooled source and recovering the resultant metal values. An improvement in this process is effected by adding a compound containing a metal of Group IA or IIA of the Periodic Table to the source before subjecting the source to the reductive roast. Following the roast the ore is quenched in an aqueous solution and thereafter subjected to an extraction step.

4 Claims, No Drawings

ENHANCED HYDROMETALLURGICAL RECOVERY OF COBALT AND NICKEL FROM LATERITES

BACKGROUND OF THE INVENTION

In the processing of materials containing metal values, two of the main extractive methods to be considered are pyrometallurgy and hydrometallurgy. In the former, metal-containing material such as ore, slag, scrap, etc., is heated with appropriate agents such as reducing agents, fluxing agents, sulfidizing agents, chloridizing agents and/or oxidizing agents, etc., usually to the melting or fusion point of the mixture. At this temperature there is generally a separation of metallic values from gangue or waste materials. The procedure then calls for separating the metallic values from slag or waste material at a temperature at which both are molten. The phase containing the metal value is then cast to some convenient shape for use or for further refining, whichever is appropriate for the particular system involved. The very high temperatures involved in this technique are achieved via electric furnaces, blast furnaces, reverberatory furnaces, etc. Temperatures required for metals such as copper, nickel, iron would generally range from 1000° C. to 2000° C. An advantage in this method is that recoveries of the metal values are typically quite high.

The hydrometallurgy approach differs substantially from pyrometallurgy in that, although the metal bearing material such as ore, slag, scrap, etc., may be heated with agents such as reducing agents, oxidizing agents, sulfidizing and chloridizing agents as part of the procedure, the temperatures involved are generally much lower than with the usual pyro-metallurgical method. These temperatures typically may be 260° C. to about 1040° C., temperatures generally well below the fusion point of the metal-containing material.

Following this step, the treated metal-containing material then is contacted with an appropriate aqueous solution for extracting metal values by dissolution. The metal is then removed from the solution by precipitation, solvent extraction, evaporation of solvent, etc. The metal-containing residue obtained is then handled appropriately to further refine the metal. Although conditions of temperature are generally much lower than in pyrometallurgy, it is frequently found that recovery of the metal values is also lower than in the pyrometallurgical method.

A particular case where this is true concerns the extraction of nickel from lateritic nickel ores. The pyrometallurgical processes range from the use of an electric furnace for the direct smelting of ore to produce ferronickel through similar techniques involving the blast furnace in which an iron-nickel-sulfide matte is obtained. The extraction of nickel from the ore using this method is greater than 90%.

Of the several hydrometallurgy approaches used commercially for treating this type of ore, the practice on a limonite ore or a highly serpentinic ore, such as that at Nicaro, Cuba, involves roasting the ore in a multihearth furnace while a reducing gas, such as producer gas, a mixture of CO and $H_2$ passes countercurrent to the ore. Temperatures in this case range from about 485° to about 735° C. Following the roasting step, the ore is cooled in the absence of air, mixed with an ammoniacal ammonium carbonate solution and vigorously agitated and aerated. This results in the dissolution of nickel, copper, and cobalt, separating them from the bulk of the ore. This solution then is treated with steam, driving off ammonia and precipitating nickel carbonate. This product then is treated further to obtain the appropriate form of nickel or use as such. In comparison to the pyrometallurgical process, however, extractions using this method have only been of the order of 70 to 80 percent.

Several other hydrometallurgy methods involve the use of procedures which include a roasting step with clorides or sulfates, but in other than reducing atmospheres and in such a manner as to form soluble metal salts, and the roasted ore is leached with an appropriate solvent such as dilute sulfuric acid. Alternatively, in certain cases the ore can be leached directly, such as with sulfuric acid solution, but this is practical only when the magnesia content of the ore is low.

The extraction of metal values from metal bearing sources may be improved when the reductive roast is effected in the presence of certain additives such as added halides, added sulfur, added sulfur-containing compounds or combinations of these additives.

It has now been discovered that a beneficial effect is obtained when subjecting freshly reduced metal sources to a quenching operation in which the source has been reductively roasted in the presence of a compound containing a metal of Group IA or IIA of the Periodic Table. By utilizing this step it is possible to obtain a greater recovery of desired metal values from the source than has heretofore been possible.

DESCRIPTION OF THE INVENTION

This invention relates to an improvement in the process for the extraction of metal values from metal bearing sources. More specifically, the invention is concerned with an improvement in a process for the recovery of metal values from metal bearing sources in which said source is heated in a reducing atmosphere in the presence of at least one additive of the type hereinafter set forth in greater detail and in the added presence of a compound containing a metal from Group IA or IIA of the Periodic Table. Thereafter the reduced source is subjected to a quenching operation in an aqueous solution followed by extraction of the desired metal values in an acidic or basic medium.

The hydrometallurgical extraction of metal values from a metal bearing source is improved when the reductive roast is effected in the presence of certain additives. A particularly attractive additive comprises a hydrogen halide or precursor thereof. In addition to the additives such as a sulfur containing compound including elemental sulfur, pyrite, gaseous sulfur compounds such as hydrogen sulfide, sulfur dioxide, etc., are also employed either alone or in combination with the hydrogen halide. The additives may contact the metal bearing source prior to or during a reductive roast which is effected in an atmosphere of the type hereinafter set forth in greater detail. After subjecting the source to the reductive roast, it is thereafter cooled and extracted by utilizing either an acidic or basic medium. However, the extraction or leaching of the reduced ores suffers a drawback in the recovery of certain metals such as the recovery as cobalt from a laterite ore in that the ore will adsorb some of the cobalt back onto the ore surface during the leaching operation. As will hereinafter be shown in greater detail, we have now discovered that improved yields of desired metal values such as cobalt may be accomplished by utilizing certain process steps hereinafter set forth in greater detail.

It is therefore an object of this invention to provide an improved process for the hydrometallurgical recovery of metal values.

A further object of this invention is to provide an improvement in the recovery of desired metal values such as cobalt from metal bearing sources whereby said cobalt will be recovered in greater yields.

In one aspect an embodiment of this invention resides in a hydrometallurgical process for the recovery of metal values from a metal bearing source which comprises subjecting said source to a reductive roast at an elevated temperature in contact with at least one additive, cooling the reduced metal bearing source, extracting the cooled reduced metal bearing source and recovering the resultant metal values, the improvement which comprises adding a compound containing a metal of Group IA or IIA of the Periodic Table to said metal bearing source prior to said reductive roast and quenching said reduced source with an aqueous solution prior to said extraction.

A specific embodiment of this invention is found in a hydrometallurgical process for the recovery of metal values which comprises adding calcium oxide to a lateritic ore, subjecting said ore to a reductive roast at a temperature in the range of from about 500° to about 1000° C. in contact with hydrogen chloride and elemental sulfur, cooling the reduced metal bearing source, quenching said source with water at a temperature less than about 100° C., extracting the reduced ore with an ammoniacal leach solution, and recovering the desired metals.

Other objects and embodiments will be found in the following further detailed description of the present invention.

As hereinbefore set forth, it has now been discovered that improved yields of desired metal values may be achieved by effecting the reductive roast in the presence of a compound containing a metal of Group IA or IIA of the Periodic Table. The process is particularly effective when attempting to recover cobalt from a metal bearing source such as a laterite ore. When utilizing the conventional hydrometallurgical recovery of metals such as nickel and cobalt from laterite ore, a certain amount of cobalt is lost during the leaching of the reduced ore by adsorption from the ammoniacal solution onto the freshly reduced ore. In order to overcome this disadvantage and concomitantly obtain an increased yield of cobalt, the adsorption must be minimized. In the process of the present invention this adsorption is minimized by blocking the adsorption sites on the ore. The blocking is accomplished by utilizing a less valuable metal ion which is adsorbed on the available sites on the ore surface, and thus when the freshly reduced ore is forwarded to the leaching step of the process in an ammoniacal solution, the more valuable metal ions are leached from the ore into the solution and thus are more readily recoverable.

The reductive roast of the metal bearing source is effected in contact with at least one additive selected from the group consisting of halides, solid sulfur, sulfur-containing compounds, or combinations thereof. The presence of the additives will provide for an increased yield of the desired metal values which are extracted from the metal bearing source. While the exact reason for the improved results or the mechanism by which they are accomplished are not known, several explanations therefor may be offered, with the understanding that the applicants do not intend to be limited thereto. One explanation is that the additives may act to reduce or to facilitate reduction of the combined metal or to otherwise assist in liberating the metal, whereby it is readily extractable. Another explanation is that the combination of additives may act or facilitate such action to reduce the metals in an iron metal alloy to thereby convert the metals into a readily extractable form. Still another explanation is that the combination of additives may act to prevent recombination of the metal into a form in which it is less readily extractable.

It is recognized that different ores respond differently to different additives and that greater improvement in the recovery of metal values may be obtained with some ores when the roasting is conducted in contact with a mixture of added gaseous sulfur compound and added sulfur or in contact with added gaseous sulfur compound and added halides or when the roasting is effected in contact with all three of these additives. Also, it is recognized that some added gaseous sulfur compounds will respond differently in this system than other added gaseous sulfur compounds. Accordingly, the specific added gaseous sulfur compound and added sulfur and/or added halide will be selected with reference to the particular ore to be processed.

As hereinbefore set forth, improved recovery of metal values is obtained when the roasting of the metal-containing material such as ore, slag, scrap, etc., is effected in contact with additives such as gaseous sulfur compounds, added solid sulfur, and/or added halides, whereby the recovery of the metal value is effected in a considerably higher yield than heretofore obtained in the hydrometallurgical system.

The process of the present invention may be used for the recovery of metal values from ore, slag, scrap or other metal bearing source and is particularly applicable to the recovery of nickel from such sources. However, it is to be understood that the process may be used for the recovery of other metal values including, for example, cobalt, copper, manganese and other metals which are soluble in ammoniacal solutions, but not necessarily with equivalent results. In the interest of brevity, the following discussion will be directed to the recovery of nickel and cobalt, with the understanding that it may be applied to the recovery of other metals as hereinbefore set forth.

As another advantage to the present invention, the process may be conducted in conventional apparatus and may utilize much of the conventional steps or prior art processes. Accordingly, the ore such as a lateritic nickel ore or other metal bearing source is prepared in a manner suitable for the process, such as finely divided or comminuted particles in a conventional way. The particles may be within a size range of from about 4 mesh to about 500 mesh or smaller and preferably within a range of from about 30 mesh to about 200 mesh. The particles then preferably are dried in a conventional manner to lower the moisture content of from about the usual 25% to 50% down to about 3% or 10% or less. The drying generally is effected in a rotary kiln at conventional temperatures.

The added sulfur compound will be used in a sufficient concentration for the purpose and may be within the range of from about 0.01% to about 10% and preferably from about 0.1% to about 5% by weight of the ore. Any suitable gaseous sulfur compound may be used in the present invention. Preferred gaseous sulfur compounds comprise hydrogen sulfide, sulfur dioxide, sulfur trioxide, carbonyl sulfide, carbon monosulfide, carbon disulfide, etc. For ease of use, the added sulfur compound preferably is normally in gaseous form. In addition, the solid sulfur which may, if so desired, be used will be in solid forms including powder, flour, granules, pellets, etc. Generally speaking, the sulfur is employed in a concentration of from about 0.01% to about 5%, and preferably from about 0.15% to about 3% by weight of the ore. When the additive comprises a hydrogen halide, the hydrogen halide is used in a concentration of from about 0.01% to about 10% and preferably from about 0.1 to about 5% by weight of the ore. Any hydrogen halide gas may be used, and preferably comprises hydrogen chlordie or hydrogen bromide, although it is also contemplated within the scope of this invention that hydrogen iodide or hydrogen fluoride may also be employed but not necessarily with equivalent results. In still another embodiment, a precursor of hydrogen halide may be used and may be selected from free halogen, chlorine, bromine, iodine, fluorine or other suitable compounds selected from metal halides, boron halides, carbon halides, phosphorous halides, silicone halides, etc.

In the preferred embodiment the additives are in gaseous form in order to utilize a dry system for the hydrometallurgical recovery of the metal values. The use of a dry system possesses several advantages of a wet system. For example, a wet system will utilize more costly or expensive equipment and, in addition, will also entail higher operating costs such as that required for fuel. In a wet system, a sufficient amount of heat must be added to remove any moisture which is present in the system. A dry system is non-corrosive in nature as opposed to a potential corrosion problem which may arise when employing wet acids as additives for the process. Other advantages which are found when employing a dry system in the process entails the potential which is present to recover a higher percentage of additives for reuse than is possible when employing a wet system. In addition, another potential which exists is the higher recovery of metal values due to a higher extraction of the desired metal from the metal bearing source.

The process is effected by subjecting the feed stock which may comprise an ore such as a laterite ore to a grinding or crushing step in which the feed stock is ground to the desired particle size, said grinding means including a ball mill or any other type of crushing or grinding apparatus which is known in the art.

Thereafter the feed stock is then contacted with a compound containing a metal of Group IA or IIA of the Periodic Table. The compounds which may be employed in an amount in the range of from about 1 to about 15% by weight of the ore will include salts such as lithium carbonate, sodium carbonate, potassium carbonate, rubidium carbonate, cesium carbonate, lithium chloride, sodium chloride, potassium chloride, rubidium chloride, cesium chloride, lithium bromide, sodium bromide, potassium bromide, rubidium bromide, cesium bromide, lithium nitrate, sodium nitrate, potassium nitrate, rubidium nitrate, cesium nitrate, lithium sulfate, sodium sulfate, potassium sulfate, rubidium sulfate, cesium sulfate, magnesium carbonate, calcium carbonate, strontium carbonate, barium carbonate, magnesium chloride, calcium chloride, strontium chloride, barium chloride, magnesium bromide, calcium bromide, strontium bromide, barium bromide, magnesium oxide, calcium oxide, strontium oxide, barium oxide, etc. In the preferred embodiment of the invention the compound which is employed will comprise lime (calcium oxide) due to its greater availability and lower cost. The reductive roast which follows the addition of these compounds will convert the compounds to soluble salts which is an important feature to be utilized in subsequent steps in the operation. The reductive roast of the feed stock is effected in conventional reducing zones including, for example, multiple hearth furnace, fluosolids roaster, Herreshoff furnace, etc. The chemical reduction of the ore is effected by means of a suitable reducing gas mixture which, here again, is of the general type used in conventional processes. Any suitable reducing gas mixture may be used and preferably comprises a mixture of hydrogen, carbon monoxide, carbon dioxide and water vapor. The gas mixture may come from any suitable source, including producer gas, gases formed by the combustion of city gas, gases formed by combustion of oil, etc. The specific gas mixture will be selected to effect the desired reduction of the nickel compounds. An illustrative gas mixture comprises a $CO:CO_2$ ratio within the range of about 0.1:1 to 10:1, a $CO:H_2$ ratio of about 0.1:1 to 10:1 and a $H_2:H_2O$ vapor ratio of about 0.1:1 to 10:1, all being on a volumetric basis. In one embodiment, it is desirable to maintain the gas mixture within the ratios set forth above, because an excessive concentration of one or more of the components in the gas mixture may have undesired effects such as, for example, incomplete reduction of the metal compound, excessive adsorption of the gas in the ore particles, etc. It is understood that the gas mixture may contain other components as, for example, nitrogen, when advantages appear therefor. Another illustrative gas mixture comprises hydrogen, nitrogen and water vapor. Still another gas mixture may comprise natural gas.

The reduction of the metal compounds to the free metal is effected at a temperature in the range of from about 500° to about 1000° C. and preferably in a range of from 650° to about 900° C. The relatively low temperature utilized in the reduction avoids the objections inherently present in the prior art high temperature reduction processes. In addition, the reduction is also effected in a relatively short period of time and thus further constitutes another advantage to the method of the present invention.

The reduced ore particles are withdrawn from the reducing zone and thereafter further processed in a manner for the hydrometallurgical extraction of the desired metal values such as nickel and cobalt. The effluent from the reduction zone is first cooled several hundred degrees and is thereafter passed into a quench zone which comprises an aqueous solution such as water. The soluble salt which has been formed during the reductive roast will be dissolved from the ore and the metal ion adsorbed by the active sites on the ore surface, thus blocking adsorption of more valuable metal ions in latter processing, inasmuch as the adsorption sites on the ore are already occupied by the less valuable metal. The quench of the reduced ore is effected at a temperature preferably less than about 100° C. After completion of the quench and soaking of the ore which may be effected during a period ranging from about 0.05 to about 1.0 hours, the ore is then leached by passage to a leaching solution.

Any suitable leaching solution may be employed and preferably comprises aqueous ammonium carbonate solution containing from about 2% to about 25% and preferably from about 3% to about 15% $NH_3$ and from about 1% to about 15% and preferably from about 1.5% to about 7.5% $CO_2$. The leaching is effected at a temperature below 95° C. and conveniently between 25° and 55° C. Ambient pressure or superatmospheric pressure may be used, but generally will not exceed about 100 psig. As hereinbefore set forth, the leaching is effected in the presence of oxygen, which may comprise ambient air when the leaching is effected in open tanks or vessels, or it may comprise air introduced into closed zones. It is understood that, in the place of air, oxygen or other suitable oxygen-containing source may be utilized. It is also comtemplated within the scope of this invention that the leaching may also be effected in an acidic medium by employing mineral acids such as hydrochloric acid, sulfuric acid, or nitric acid, etc., in a concentration of from about 1 to about 20% by weight of acid.

Upon completion of the leaching step of the process, the solution of soluble metal values is withdrawn from the leaching and thickening zones and is thereafter treated in any suitable manner to precipitate the desired metal values and recover the same. For example, one method of recovering nickel is accomplished by steaming to precipitate the nickel carbonate or other nickel salts and to volatilize off ammonia, carbon dioxide and water. Thereafter the precipitated nickel carbonate can be treated in any conventional manner to recover the desired metal.

In addition to the recovery of nickel as hereinbefore described, it is also possible to recover other metals which may be present in the metal bearing source such as copper, cobalt, etc. For example, the cobalt which, due to the presence of other metal ions, has not been adsorbed on the reduced ore may be recovered by treating the leach solution with an organic compound such as an oxime to separate the nickel and cobalt and recover the cobalt in a greater recovery percentage than has heretofore been possible. If so desired, the cobalt may also be recovered by treating the extract with a solid adsorbent such as lignite, peat, etc., whereby cobalt ions are adsorbed on the solid adsorbent and effectively separated from the nickel.

As will hereinafter be shown in greater detail by utilizing the steps of the present process, that is, by reductively roasting the ore in the presence of a metal compound which is capable of being converted to soluble salts during the roast period, followed by a simultaneous quenching and soaking step whereby these soluble salts are dissolved from the ore, the metal ion is thereafter adsorbed by the active sites on the ore surface, thus precluding the adsorption of more valuable metal ions in a later processing step. It is possible to attain greater recoveries of desired metal values.

The following examples are given for purposes of illustrating the process of the present invention. However, it is to be understood that these examples are given merely for purposes of illustration and that the generally broad scope of the invention is not limited in strict accordance therewith.

EXAMPLE I

In this example a 25 gram sample of a laterite ore blend from Gag Island which had the following approximate weight percent composition assay on a dry basis

| | % |
|---|---|
| Ni | 1.89 |
| Co | 0.074 |
| Fe | 20.2 |
| MgO | 13.4 |
| $SiO_2$ | 32.5 |

was treated with an additive mixture comprising 4% hydrogen chloride and 1% sulfur which were added in a pretreatment plugging step along with 10% by weight of lime (CaO). In addition, 1% hydrogen chloride was added to the reducing gas following which the ore was then roasted in a steel tube with external heating for a period of 1 hour at a temperature ranging from 260° to 788° C. Following the reductive roast the reduced ore was then cooled to room temperature and subjected to an ammoniacal ammonium carbonate extraction in a manner known in the art for a period of 2 hours. In a series of three tests, it was found that 64.5%, 67.7%, and 65.3% of the cobalt was extracted.

EXAMPLE II

In this example the above experiment was repeated in a similar manner with the exception that after subjecting the ore containing the lime, hydrogen chloride and sulfur to a reductive roast for a period of 1 hour, the ore was cooled and quenched with water at ambient temperature for a period of 1 hour. Following the quenching and soaking step, the reduced ore was then subjected to an ammoniacal ammonium carbonate extraction where it was found that the amount of cobalt extracted comprised 75.6%, 75.0% and 75.8%, respectively.

When the ore described in Example I above was subjected to an extraction test similar in nature to those hereinbefore described, but in the absence of any addition of lime to the ore before roasting, the amount of cobalt extracted was only in a range of from about 50–55%.

EXAMPLE III

In this example an ore blend from Puerto Rico which had the following composition:

| | % |
|---|---|
| Ni | 0.99 |
| Co | 0.080 |
| Fe | 20.3 |
| MgO | 15.0 |
| $SiO_2$ | 34.0 |

was subjected to an extraction process similar to that described in the above examples. In the first test, the reduction of the ore was effected in the absence of any lime and resulted in the obtention of about 40% of the cobalt.

In a similar test wherein lime added to the ore before the reductive roast thereof followed by a cooling and ammoniacal ammonium carbonate extraction without quenching and soaking the reduced ore, the cobalt extraction was about 42.7%.

In contradistinction to the above tests when the hydrometallurgical process for the recovery of metal values was effected in a manner according to the present invention, that is, by adding about 10% lime to the sample before the reductive roast thereof followed by a quenching with water, of the reduced ore, at ambient temperature, followed by an ammoniacal ammonium carbonate leach, the amount of cobalt extracted ranged from 60.6% to 68.6%.

It is therefore readily apparent from a comparison of the amount of cobalt extracted from a laterite ore utilizing the process of the present invention, that is, quenching the reduced ore which had been roasted in the presence of lime before leaching, resulted in the obtention of a relatively greater amount of cobalt than could be recovered when omitting one or both of the required steps.

We claim as our invention:

1. A hydrometallurgical process for the recovery of additional cobalt or nickel values from a lateritic ore via conjunct interaction of a calcium oxide additive and a quench step which comprises roasting said ore in a reductive roast at a temperature of from about 500° C. to about 1000° C. in contact with (1) at least one additive selected from the group consisting of from about 0.01 to about 10% of a hydrogen halide by weight of the ore, from about 0.01 to about 5% elemental sulfur by weight of the ore and from about 0.01 to about 10% of a sulfur compound, and (2) an additive consisting essentially of from about 1 to about 15% by weight of said ore of calcium oxide, wherein said calcium oxide is added to said ore before initiation of said reductive roast, cooling the reductively roasted ore and additives, quenching prior to extraction said cooled reductively roasted ore and additives with a quenching agent consisting essentially of water at a temperature less than about 100° C. and extracting cobalt or nickel from said quenched lateritic ore via an ammioniacal leaching solution.

2. The process as set forth in claim 1 in which said hydrogen halide is hydrogen chloride.

3. The process as set forth in claim 1 in which said additive comprises a combination of hydrogen halides and a sulfur compound in the recited weight percentages.

4. The process as set forth in claim 1 in which said elevated temperature for the reductive roast is in a range of from about 650° to about 900° C.

* * * * *